US005388837A

United States Patent [19]

Hoffman

[11] Patent Number: 5,388,837

[45] Date of Patent: Feb. 14, 1995

[54] GAME OF MILITARY STRATEGY

[76] Inventor: Emile Hoffman, 6731 New Hampshire Ave. Apt. #206, Takoma Park, Md. 20912

[21] Appl. No.: 97,118

[22] Filed: Jul. 27, 1993

[51] Int. Cl.[6] ..... A63F 3/00
[52] U.S. Cl. ..... 273/262
[58] Field of Search ..... 273/242, 243, 255, 262

[56] References Cited

U.S. PATENT DOCUMENTS

| | | | |
|---|---|---|---|
| 2,703,713 | 3/1955 | Moyer | 273/262 |
| 3,155,391 | 11/1964 | Chittenden | 273/262 X |
| 3,343,841 | 9/1967 | Arend | 273/262 |
| 3,831,944 | 8/1974 | Upton | 273/262 |
| 4,111,428 | 9/1978 | Barbosa | 273/262 |
| 4,161,315 | 7/1979 | Walton | 273/262 |
| 4,373,731 | 2/1983 | Whiteman et al. | 273/262 |
| 4,753,441 | 6/1988 | Braus et al. | 273/255 |
| 4,783,080 | 11/1988 | Rosenwinkel et al. | 273/255 |
| 4,801,148 | 1/1989 | Lamb | 273/255 |
| 4,984,807 | 1/1991 | Shiryon | 273/262 |

FOREIGN PATENT DOCUMENTS

| | | | |
|---|---|---|---|
| 2569124 | 2/1986 | France | 273/262 |
| 2018141 | 10/1979 | United Kingdom | 273/262 |

*Primary Examiner*—William E. Stoll
*Attorney, Agent, or Firm*—Keil & Weinkauf

[57] ABSTRACT

A board game involving strategy, chance, perception and decision wherein the board comprises a playing surface having indicia corresponding to a plurality of blocks of equal dimensions. Each of the larger blocks is subdivided into four smaller blocks. A plurality of playing pieces are provided for the players. These playing pieces are representative of moveable armed forces and weapons systems that can be moved about the board. A monetary aspect of the game assigns a monetary value to each group of game pieces. The distance each piece is moved is determined by the colored squares of the board. The playing pieces also comprise fixed targets. Some of the playing pieces have status power indicated by a selector dial attached to the playing piece whereby a game piece of higher status power has the potential ability to kill, capture or wound a game piece of lesser status power.

4 Claims, 3 Drawing Sheets

GAME OF MILITARY STRATEGY

BACKGROUND OF THE INVENTION

This invention relates generally to strategic and tactical board games and more specifically to those employing playing pieces that represent adversarial units having specified capabilities, that are deployed with respect to a defined area of operation, and that are controlled in part by random instructions indicated by a die or dice, playing cards, colored board squares and the like.

A number of games have been designed that attempt to simulate certain realistic but hypothetical situations. Many of these games employ stationary game pieces, and many others offer players no active control over the movement of game pieces after their initial deployment, the subsequent progress of the game being dictated by mere chance. Most of the games are designed to provide pure entertainment, and few proffer an opportunity for players to develop limited or even tactical and strategic skills.

SUMMARY OF THE INVENTION

In accordance with the present invention, a military warfare board game is provided that offers, in addition to an entertaining diversion, an opportunity to learn military strategy and tactics in a "true-to-life" battle scenario.

The preferred embodiment of the present invention contemplates a board game in which players may optionally set up a number of simulated areas such as minefields, walls, and hostage areas.

The preferred embodiment of the invention also contemplates a board game that is dynamic in that it affords players substantial opportunity to place and move game pieces according to their own strategies and tactics, thereby simultaneously stimulating an interest in and assisting in the development of these skills and in thought processes generally. A monetary aspect of the game that assigns monetary value to each group of game pieces provides further entertainment and interest.

The instant embodiment also contemplates a board game the playing of which involves significantly realistic factors such as the game pieces that are representations of actual troops and implements of war, some of which have capabilities for eliminating, wounding or capturing other game pieces by a "status" conferred on the game piece by suitable means such as a selector dial. Power-cards aid selector dials in determining whether a game piece is killed, captured or wounded.

Also contemplated by the preferred embodiment of the present invention is a board game that is economical and easy for a manufacturer to fabricate and that is easy for a user to set up, transport and store.

DESCRIPTION OF THE PREFERRED EMBODIMENT

Figure 1:
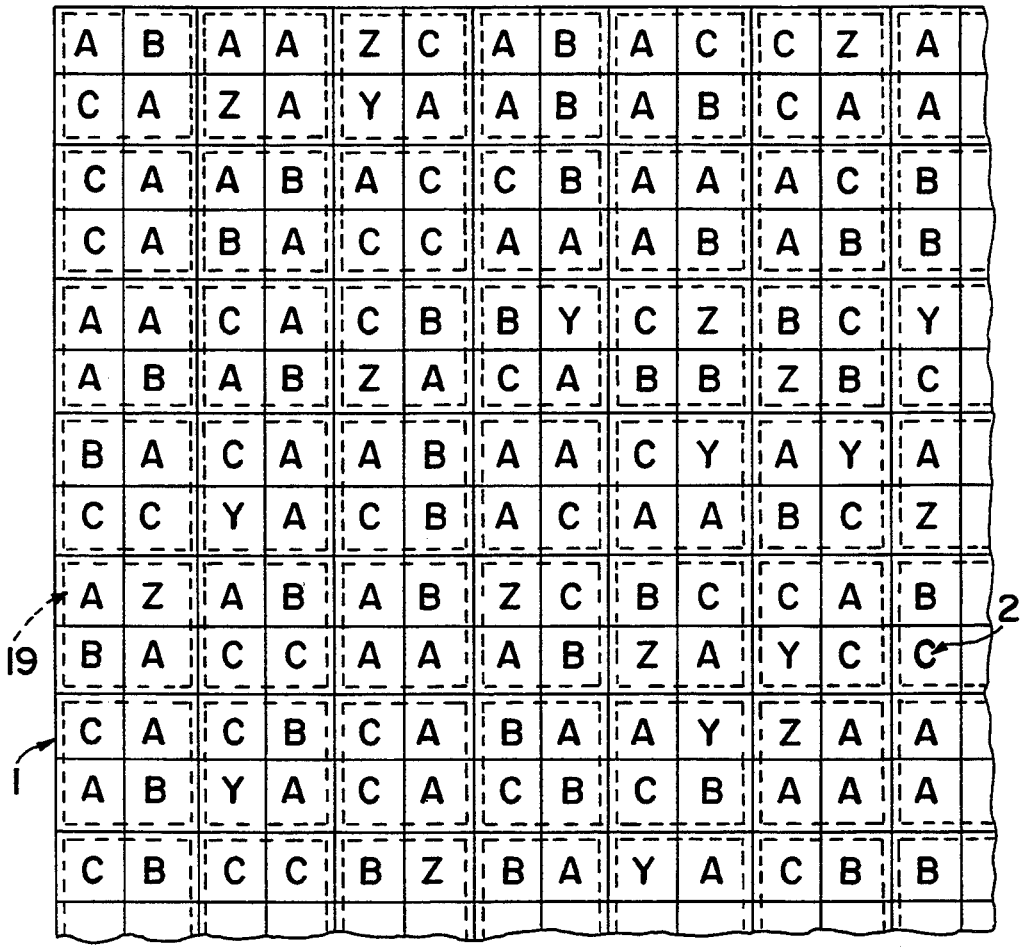
FIG. 1 shows a partial view of the playing surface (1), with the surface divided into large squares (19) as shown by the dotted lines, each larger square further divided into four smaller squares (2) identified with various letters representing different colors, A representing white, B blue, C green, Y orange, and Z representing red.
Figure 2:
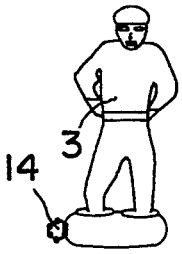
FIG. 2 shows a soldier playing piece (3) with a selector playing piece (14) affixed.
Figure 3:
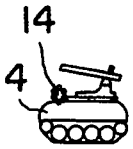
FIG. 3 shows a tank playing piece (4) with a selector playing piece (14) affixed.
Figure 4:
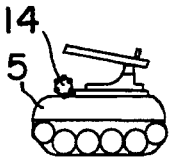
FIG. 4 shows a heavy tank playing piece (5) with a selector playing piece (14) affixed.
Figure 5:
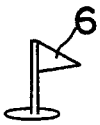
FIG. 5 shows a configurator playing piece (6).
Figure 6:
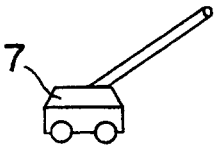
FIG. 6 shows an artillery playing piece (7).
Figure 7:
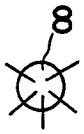
FIG. 7 shows a mine playing piece (8).
Figure 8:
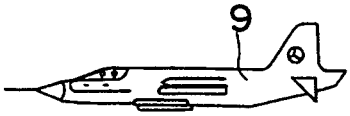
FIG. 8 shows an aircraft playing piece (9).
Figure 9:
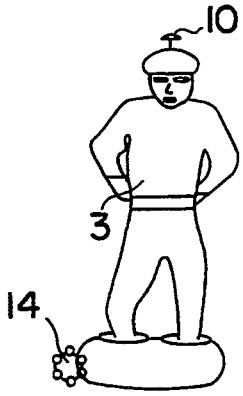
FIG. 9 shows a soldier playing piece (3) with Ka-Pika (10) and selector (14) playing pieces affixed.
Figure 10:
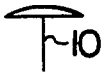
FIG. 10 shows a Ka-Pika playing piece (10).
Figure 11:
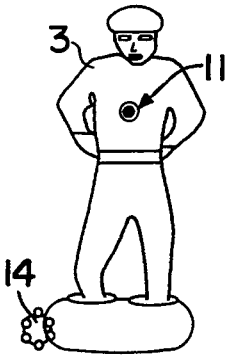
FIG. 11 shows a soldier playing piece (3) with pika (11) and selector (14) playing pieces affixed.
Figure 12:
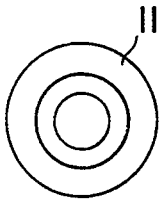
FIG. 12 shows a pika playing piece (11).
Figure 13:
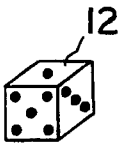
FIG. 13 shows a die (12).
Figure 14:
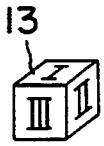
FIG. 14 shows a wounded die (13).
Figure 15:
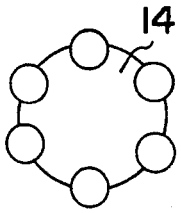
FIG. 15 shows a selector playing piece (14).
Figure 16:
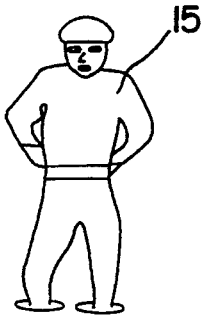
FIG. 16 shows a decoy playing piece (15).
Figure 17:
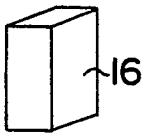
FIG. 17 shows a figurator playing piece (16).
Figure 18:
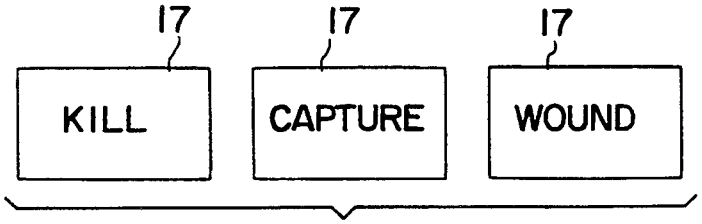
FIG. 18 shows the various power cards (17).
Figure 19:
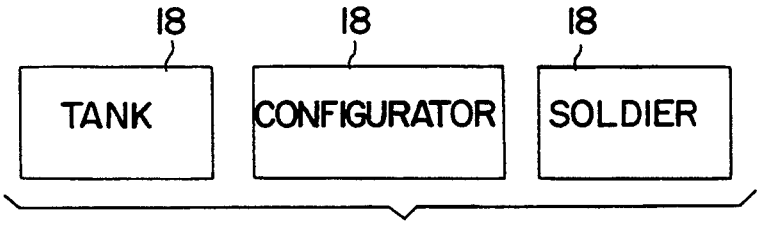
FIG. 19 shows the various playing cards (18).

Referring now to the drawings in which like parts are designated by like reference numerals throughout the several views, there is shown in FIG. 1 a board game (1), with a substantially horizontal playing surface (2), defined by an array of large squares of equal dimensions. Each of the large squares is subdivided equally into four smaller blocks. A plurality of playing pieces are provided for the players (FIG. 2). These playing pieces are representative of moveable armed forces and weapons systems that can be moved about the board. The playing pieces include soldiers (3), tanks (4), heavy tanks (5), configurators (6), artillery (7), mines (8), and aircraft (9) Ka-Pikas (10), pikas (11), die (12), wounded die (13), decoys (15), figurators (16), power cards (17) and playing cards (18). These game pieces are miniature statuettes or the like, made from a polymer, metal or the like. Other game pieces include aircraft marker configurators and a die. Rules of play concerning each game piece are described below.

METHOD OF PLAY

Play is governed by rules concerning the regular play method and the single play method. Players, according to their time limits for the game and to their level of skill and expertise, can select any one of these two methods to play the game.

Regular Play Method

At the beginning of the game each team is issued one hundred soldiers, three generals and ten officers. The officers include five lieutenants, three captains and two colonels. These pieces are positioned on the board.

The die is then rolled to determine the status power of the game pieces each player elects to move on the board. The distance each game piece is moved is determined by the board's colored squares.

Players must try to kill, capture or wound the other opponent's pieces. The object of the game is to kill the other side's three generals.

Single Play Method

This method is essentially the same as the regular play method except that, after the roll of the die, a player may choose one of the following "plays" whereby each designated game piece is moved across the number of squares according to the rules for each game piece. Generally, only heavy tanks may move across large squares.

| Play number | Permissible move |
|---|---|
| 1 | 5 soldiers |
| 2 | 3 soldiers and 1 artillery |
| 3 | 3 soldiers and 2 tanks |
| 4 | 3 tanks |
| 5 | 1 heavy tank |
| 6 | 3 soldiers and 3 configurators |
| 7 | 2 soldiers and 1 configurator |

SPECIAL RULES FOR THE PLAYING PIECES

The Board

The board has single and complete squares. Complete squares consist of four single squares. The perimeter of complete squares are signified by broken lines (10). Each single square has a color. The color represents the distance a game piece can move once on that square. A game piece on a green square can only move three single squares or places. A game piece on a blue square can only move two squares or places.

The board colors represent powers of movement or how a game piece may move from one square to another.

There are two rules to the movements of game pieces on the colored squares of the board.

There are two squares of game pieces in relation to the rules of the colored squares of the board. The game pieces are divided into Team A and Team B pieces. The only difference between Team A and Team B pieces is, Team B pieces have insignias. Team A pieces are without insignias.

a) Rules

A Team A game piece on a green square may only move three squares or places. A team A game piece on a blue square may only move two squares or places. A team A game piece on a white square may only move one square or place.

A team B (with insignia) game piece on a green square may move two or four squares or places. A Team B game piece on a blue square may move one or three square or place. A game piece on a white square may only move one square or place.

Power square rules apply to both teams A and B pieces. Team rules only apply to the movement of pieces on the colored squares of the board.

b) The Power Squares

The power squares are red and orange. Red squares have a "Z" insignia, orange squares have an "Y" insignia (FIG. 1). A game piece on a red power square has a "super" power of movement. It may move one to six squares in any direction. A game piece on an orange square may move one to five squares in any direction.

c) The Complete Squares

Only heavy tanks may move from one complete square to another.

Soldier, tanks and Artillery Selectors

Soldiers, artillery and tanks have attached to them, as a moveable circular disk or the like, a selector (14). Selectors may be made out of plastic, metal or polymer. They are permanently attached to game pieces. They may be attached to the bottom of soldier pieces and on the body of tank pieces. A throw of the die confers status power on the game piece to which a selector dial is attached. The selector dial, which is divided into six segments corresponding to the possible throws of a dice, determines the status power of the playing piece. The sectors may be designated by a color which corresponds to a number from one to six, such that, for example, red denotes six power, black denotes five power, purple denotes four power, and so on. Alternatively, the sectors may be numbered individually with numbers from one to six corresponding to numbers on the die, or in any other fashion apparent to a person skilled in the art to achieve the aims of the selector. Each time a die is thrown and a playing piece possessing a selector is chosen to be moved as a result of the die throw, the playing piece attains the "power" of the die throw result. The selector on the playing piece is turned to indicate the status power of the piece before the playing piece is moved the number of squares indicated by colored squares on the playing board. The selector determines whether a soldier of one side can kill, capture or wound an opponent's soldier. For example, a soldier with status power of six can kill a soldier with status power of one to five inclusive. A soldier with status power of two can not, however, kill an enemy soldier with a status power of five. A game piece can not kill, capture or wound another game piece of the same status. After rolling the HOFFMAN, Ser. No. 08/097,118 dice, and before moving the desired playing piece on the board, its selector disk must be returned so that the number on the disk corresponds to the number on the die.

Playing Cards

The game comprises a plurality of playing cards (19). A typical example of the set of playing cards would be the following:

50 designated tank cards
50 designated figurator cards
40 designated configurator cards
16 designated special forces cards
12 designated grenadier demolition cards
10 designated heavy tank cards
6 designated artillery cards
7 designated minefield cards The playing cards are distributed between the teams at the start of play and, depending on which cards the teams draw, game pieces corresponding to the card designations are issued to each team. The strength of each team's military force is thus determined. Each player then substitutes the designated playing card for a designated figurator which can be brought into play as more specifically described below.

Aircraft

The airforce plays an important part in the overall framework of the game. An aircraft is capable of destroying enemy soldiers, tanks, artillery and aircraft when used in conjunction with the configurators as described more fully below.

Configurators (6) are used by each team to "target" opposing forces for destruction by the targeting team's aircraft and artillery. Configurators are made out of plastic or polymer. They look like miniature flags. Each configurator is a single piece, and is neither attached to another piece nor can it have another piece attached to it. A team in possession of a configurator may, at any time upon rolling the die, move a configurator to a square occupied by a tank, artillery, soldier or mine of the opposing team. As a result of this move, the opposing team's game piece is "targeted" and may be "destroyed" by artillery or an aircraft of the team responsible for moving the configurator to such a position. To destroy the targeted piece, the moving team uses a roll of the die to launch a strike on the target using artillery or an aircraft. If the strike is accomplished by an aircraft, the aircraft returns to its base.

Aircraft Bases

Aircraft bases are the center of operations for aircraft and aircraft configurators, and are also the safety zone for aircraft, soldiers and generals. Only artillery can destroy an aircraft base.

Tanks

The tank game pieces comprise tanks (4) and heavy tanks (5). Tanks are able to move across the game board one square at a time while heavy tanks move from the center of a four-square quartet (19) to the center of an adjacent four-square quartet. When a heavy tank attacks opposing forces in an adjacent foursquare quartet the attacking player may choose which of the opposing forces in an of the four squares are to be eliminated.

Figurators

Figurators are positioning chips made out of plastic, polymer or metal. Figurators are only used to position game pieces on the board at the beginning of the game and intermittently during the game. They provide an added benefit of surprise and tactical position. Figurator pieces are later replaced by regular playing pieces.

Power Cards

Power cards (19) are aids to the selector dial (14). If a game piece of a higher selector dial battles against a game piece of a lower selector dial, power cards aid in determining if the game piece of the higher selector status kills, captures or wounds (damages) the game piece of the lower selector status.

On each power card is written kill, capture or wound (damage). There are three theories for power cards: the kill theory, the capture theory and the wound (damage) theory.

The Kill Theory

The kill theory is used whenever a kill power card is presented by the player whose game piece has the higher selector dial. According to the kill theory, the game piece with the higher selector dial kills or eliminates the game piece of the lower selector dial.

The Capture Theory

According to the capture theory, a game piece of the higher selector dial captures a game piece of lower selector dial. Once a capture power card is presented, captured game pieces may later be traded for money to buy new game pieces.

The Wound Theory

The wound theory is a theory of engagement between two opposing game pieces in which they are wounded instead of being killed or captured. The wound theory requires the use of the "wounded die" (13). The wounded die is used to determine where the game piece is wounded.

After a game piece is wounded a removable adhesive dot, or similar, is placed on the wounded area to indicate that the game piece is wounded.

A penalty is charged whenever a wounded game piece is killed. The penalty is fifty dollars for the killed piece that was wounded in the legs. A seventy-five dollar penalty is charged for the killed game piece that was wounded in the arms. A game piece that is wounded in the head has only one play before dying or being eliminated.

The Monetary Aspect

Each group of game pieces has certain monetary values. The monetary aspect of the game comes into play when captured pieces are traded for money to buy new pieces (tanks, soldiers, etc.). It is in a player's best interest to capture pieces with the highest monetary value.

| The Value of Game Pieces | |
|---|---|
| Soldiers | $200 |
| Tanks | 600 |
| Heavy Tanks | 2,000 |
| Artilleries | 2,500 |
| Configurators | 1,000 |
| Lieutenants | 1,000 |
| Captains | 2,000 |
| Colonels | 4,000 |
| Generals | 6,000 |

The Monetary Vault

The money vault is a depository of money that is used to compensate players whose game pieces kill or capture the opponent's pieces.

The player or players whose wounded game piece is killed pays into the vault as a penalty for allowing a wounded game piece to be killed. Players do not exchange money, it is only done through the vault.

Officers

Officers are used in the game for added suspense. They have no selector nor any status. They are basically used as financial chips. When officers are captured, they are traded in for money value. It is advisable to save power cards for capturing officers because they have some of the highest monetary values. Officers are lieutenants, captains, colonels and generals.

Group Power

Group power is the quality that makes a game piece of a certain group superior to a game piece of another group. A tank has a higher group power than a soldier. A heavy tank has a higher group power than a tank.

Group power is determined by the Group Level Chart.

1. heavy tanks
2. tank, configurators
3. soldiers

Heavy tanks are on the highest level of group power.

Group power is different from selector power in that it is a quality when game pieces of different groups battle. Selector power is when game pieces of the same group or group level and status is determined by the selector dial.

According to the level of group power a solider can not kill, capture or wound (damage) a tank. A tank can not kill, capture or wound (damage) a heavy tank. There is an exception to this rule, as described below.

Exception Rule (The Challenge)

The only time a game piece of a lower group level can challenge a game piece of a higher group level is when it is on maximum selector (red for example). Maximum selector is the highest selector dial.

EXAMPLE: Selector dial values

| Selector Colors | Dice Value |
|---|---|
| Red (maximum selector) | Six |
| Black (semi-max selector) | Five |
| Purple | Four |
| Green | Three |
| Blue | Two |
| Yellow | One |

When a game piece on maximum selector challenges a game piece of a higher group level, the player whose game piece challenges must roll the dice again. If the roll is greater than four, then the piece that challenges kills, captures or wounds (damages) the game piece of the higher group level. If the roll is less than four, then the piece of the higher group level kills, captures or wounds (damages) the piece that challenges.

Trump Play

The trump play rules the game pieces on the two highest selector dial values; the maximum and the semi-maximum selector dial.

The trump play gives these game pieces extra turns to remain on the same selector dial regardless of changes in the roll of the dice. A game piece on maximum selector remains on it for four plays. A game piece on semi-maximum selector dial remains on that for three turns.

The Pika

The pika (11) is a small object that is attached to the game pieces. Pikas may be made out of plastic, polymer or metal. Pikas can be attached to the body of game pieces in a snapping or screwing manner, into a hole in the playing piece provided for that purpose. It is used to show how many turns a game piece on maximum or second highest selector value would have to remain on that selector dial.

Pikas have four colors. A black pika piece means a game piece has four turns to remain on that selector dial. Red means three turns, and so on.

Walls

Walls serve as temporary barriers preventing those troops positioned behind the wall from enemy attack. A wall may stay in place for eight plays.

Decoys

Decoys (15) are made out of plastic, polymer, or metal. Decoys look exactly like regular game pieces, the only difference being that they do not have selector dials. Each Decoy is a single piece, and is neither attached to another piece nor can it have another piece attached to it. Decoys are used to provide and help prevent attacks on troops. Decoys are in the form of tank and soldier pieces. Decoys have no selectors or status power, they are only used to temporarily block enemy game pieces and prevent them from attacking one's own game pieces.

When decoys attack the opponent's game pieces, the opponent's game pieces must remain confined in the square in which it was attacked for one or more plays. The length of time a game piece is confined to a square is determined by the color of the decoy. An orange decoy means the game piece is confined for three plays. A blue or green decoy means the game piece would be confined for one or two plays respectively.

Game tips

It is advisable to bring military forces onto the game board in a "piece-meal" manner by using figurators (16) intermittently. This increases a player's element of surprise.

Figurators may be positioned on the game board at any time during the game and remain in position until a player decides to replace them with their respective game piece.

Of course, there is a wide number of strategies available to a team which depend only upon the team's imagination. Various changes and modifications would be apparent to one of ordinary skill in the art upon a reading of applicant's disclosure. For example, the number and type of playing cards may be varied so suit individual preferences. These changes and modifications may be made without departing from the ambit of the invention, and applicant intends that he be limited only by the scope of the claims appended hereto.

Ka-Pikas

Ka Pikas are small objects made out of metal, plastic or polymer that snap or screw into the helmets of soldier playing pieces and the tops of tank pieces, into a hole provided for that purpose. Ka-Pikas are used to determine the "extra lives" of game pieces. They represent a certain level of play for game pieces. In the game a game piece is usually killed, captured or wounded by a game piece with a higher selector dial; however, when Ka-Pikas are used, instead of being killed, captured or wounded, game pieces are given "extra lives" or turns to continue battling against other pieces, but at lower Ka-Pika levels.

Ka-Pika comes in four different colors, and each color represents a level. The colored piece "Ka-Pika" is placed on each piece to represent how many "lives" or turns each piece has.

The Ka-Pika level of a game piece may limit its power or effectiveness in killing certain game pieces. Only game pieces on the highest Ka-Pika levels can attack generals or cities. Only game pieces on the two highest Ka-Pika levels can attack other officers.

Ka-Pikas are colored pieces that are physically placed on game pieces. Black colored Ka-Pikas are on the highest level, red is on the next level and blue and gray are the two lowest Ka-Pikas. The blue Ka-Pika is the lowest.

It is in the interest of each player to try to get as many of the opponents' pieces of lower Ka-Pika levels; therefore limiting their ability to kill officers and general game pieces. One game piece may also attack another piece, gaining a higher Ka-Pika status.

I claim:

1. A military war game combining elements of skill and chance comprising:

a substantially horizontal playing surface divided into squares each subdivided into four smaller squares, the squares being assigned a color to determine the distance a game piece can move once on that square;

at least two sets of playing pieces, one set for each of said players or team of players, said playing pieces comprising armed forces, a moveable weapons system and fixed targets, of which the soldiers and aircraft have attached to them selector dials, each having six sectors which manifest the status power of these said game pieces in accordance with the trump play rule of play;

a die, which determines status power of the selector dial, the number on the die corresponding to the sectors on the selector dial;

a plurality of playing pieces termed figurators representing the moveable playing pieces which are placed on said game board squares at the start of or during the game and which, at the option of the player upon a roll of the die, are replaced by the actual moveable game pieces;

a plurality of playing cards which are distributed between the players at the start of play and which determine the strength of each side's forces;

a plurality of playing pieces termed configurators for targeting opposing forces for destruction;

a plurality of playing pieces termed power cards which are used to determine whether a game piece is killed, captured or wounded, according to the kill, capture or wound theories of play;

a plurality of playing pieces termed decoys to provide and help prevent attacks on troops; and a small object that is placed on soldiers and tanks to show how many turns said soldiers and tanks on maximum or second highest selection value would have to remain on that selector dial.

2. A game as described in claim 1 wherein the playing pieces are assigned a monetary value.

3. A game as described in claim 1 wherein there are three groups of pieces or teams having different colored insignias representing different powers of movement in relation to the colored board squares and there are three additional squares covering four square blocks which are each cities with monetary values.

4. A game as described in claim 3 wherein marker pieces of various colors are additionally used to allow game pieces to continue battling with extra lives instead of being eliminated from the game.

* * * * *